United States Patent [19]

Reyes et al.

[11] Patent Number: 4,606,311

[45] Date of Patent: Aug. 19, 1986

[54] FUEL INJECTION CLEANING SYSTEM AND APPARATUS

[75] Inventors: Angelito Reyes, Woodland Hills; Fred Abbott, Glendale, both of Calif.

[73] Assignee: Miller Special Tools, Div. of Triangle Corp., Garden City, Mich.

[21] Appl. No.: 651,635

[22] Filed: Sep. 14, 1984

Related U.S. Application Data

[63] Continuation of Ser. No. 336,870, Jan. 4, 1982, abandoned.

[51] Int. Cl.[4] ..... B08B 3/08; B02B 77/04

[52] U.S. Cl. ..... 123/198 A; 134/123; 134/169 A

[58] Field of Search ..... 123/198 A; 134/116, 134/123, 169 A

[56] References Cited

U.S. PATENT DOCUMENTS

| | | | |
|---|---|---|---|
| 1,030,931 | 7/1912 | Silver | 123/198 A |
| 1,451,157 | 4/1923 | Gerbig | 123/198 A |
| 1,871,340 | 8/1932 | Pielstick . | |
| 2,201,774 | 5/1940 | Hofele | 123/198 A |
| 2,644,440 | 7/1953 | Bailey | 123/198 A |
| 2,645,379 | 7/1953 | Audia | 222/23 |
| 3,106,194 | 10/1963 | Cantwell et al. | 123/198 A |
| 3,173,408 | 3/1965 | Brenneman | 123/119 |
| 3,211,377 | 10/1965 | Brenner | 239/1 |
| 3,224,684 | 12/1965 | Roosa | 239/533 |
| 3,318,096 | 5/1967 | Webb | 60/258 |
| 3,338,564 | 8/1967 | Roeder | 123/198 A |
| 3,403,695 | 10/1968 | Hopkins | 137/240 |
| 3,589,388 | 6/1971 | Haneline, Jr. | 137/315 |
| 3,752,398 | 8/1973 | Svensson | 239/1 |
| 4,059,123 | 11/1977 | Bartos et al. | 134/169 A |
| 4,061,504 | 12/1977 | Zall et al. | 134/95 |
| 4,082,565 | 4/1978 | Sjolander | 134/1 |
| 4,161,160 | 7/1979 | Hicks et al. | 123/198 A |
| 4,167,193 | 11/1979 | Magnus et al. | 134/169 A |
| 4,190,346 | 2/1980 | Hutson et al. | 354/324 |
| 4,197,140 | 4/1980 | Swan | 123/198 A |
| 4,290,392 | 9/1981 | Dissmore | 123/198 A |

FOREIGN PATENT DOCUMENTS

| | | | |
|---|---|---|---|
| 529286 | 3/1979 | U.S.S.R. | 123/198 A |

*Primary Examiner*—Ira S. Lazarus

*Attorney, Agent, or Firm*—Harness, Dickey & Pierce

[57] ABSTRACT

A method and apparatus for cleaning the fuel injection system of a vehicle without disassembling the fuel injectors from the vehicle engine, the apparatus comprising a mechanism for feeding a solvent-fuel mixture into the fuel supplying system of the engine, a control system for the feeding mechanism and a series of connectors between the fuel injection system and both the feeding mechanism and the control system. The method includes connecting the feeding mechanism and the control system to the engine fuel injection system and running the engine to clean the fuel injectors on site without disassembling the fuel injectors from the vehicle engine.

16 Claims, 4 Drawing Figures

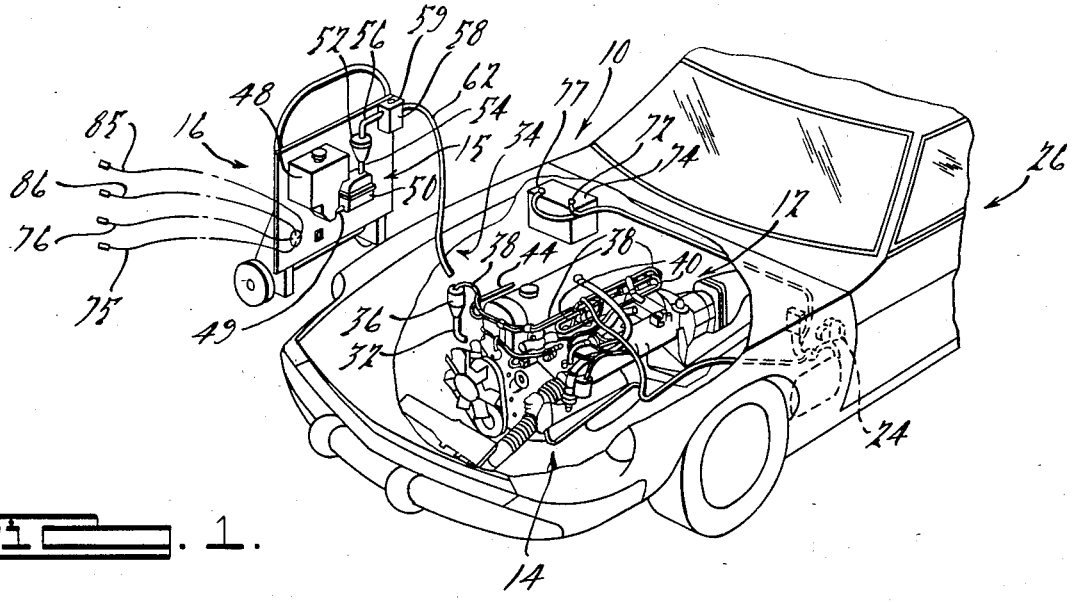
FIG. 1.
FIG. 2.
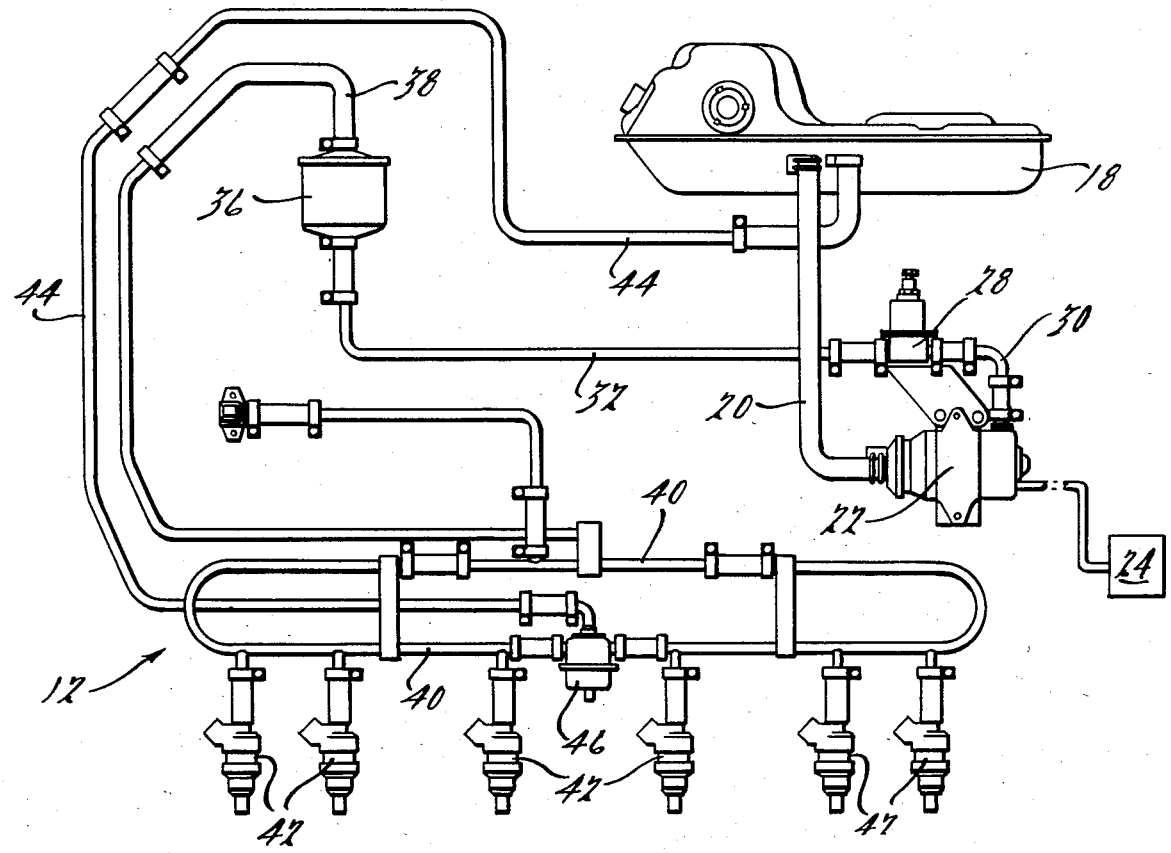

FUEL INJECTION CLEANING SYSTEM AND APPARATUS

This application is a continuation of application Ser. No. 336,870, filed Jan. 4, 1982, now abandoned.

BACKGROUND AND SUMMARY OF THE INVENTION

The present invention relates generally to a cleaning device for the fuel injection system of an engine, and in particular to a fuel injector cleaner for the engine of an automotive vehicle.

Fuel injection valves in vehicle engines, particularly the front portion of the fuel injection valves, are apt gradually to acquire an outer and inner deposit restricting the area of the fuel passage of the injection valve. Resulting modification of the function of the injector valve is particularly harmful for the type of injector valves which contain a reciprocatory sprayer needle unit and a solenoid for operating the same, since the fuel flow through the valve will vary with the area of the fuel passage. The restrictions formed by the deposits completely defeat the primary purpose of fuel injection valves to provide a more accurate metering of the quantity of fuel supplied to each of the cylinders of the engine during the suction stroke of the engine and a better control of the fuel/air weight relation in the combusted charge. Prior art methods and apparatus for deposit removal from a fuel injection valve, such as that shown in U.S. Pat. No. 4,082,565, have required removal of each fuel injection valve in order to clean the valve. Although less costly than replacement of the injection valves by a new set of valves when the valves no longer work properly, the labor cost of valve removal in itself is substantial.

Thus, the present invention has for a primary object to provide a satisfactory method for the removal of deposits from the fuel injection valves of a vehicle engine without removal of the valves. Since correct proportionality of fuel to air is extremely important to motor power and efficiency in a fuel injection engine, it would appear that a need exists to provide a system for removing deposits from a fuel injection valve in a systematic and inexpensive manner. In such a manner, the fuel injection valves could be cleaned as part of the normal maintenance schedule without an exhorbitant labor cost or expensive replacement of parts. Thus, it is another object of the present invention to provide an in situ cleaning apparatus than can be attached directly to the fuel lines of the vehicle to inexpensively and systematically clean deposits from the fuel injection valves.

A further object of the present invention in minimizing labor costs is to provide a method and apparatus for the removal of deposits from a fuel injection valve at which the laborer does not have to remain observing the process, but instead the process may be automatically timed and automatically controlled.

Other objects and advantages of the instant invention will be apparent in the following specification, claims and drawings.

BRIEF DESCRIPTION OF THE DRAWINGS

FIG. 1 is a elevated perspective view of a vehicle having and engine with a fuel injection system to which an apparatus of the present invention is operably attached;

FIG. 2 is a schematic view of the fuel injection system of the vehicle of FIG. 1;

DESCRIPTION OF THE PREFERRED EMBODIMENT

Figure 3:
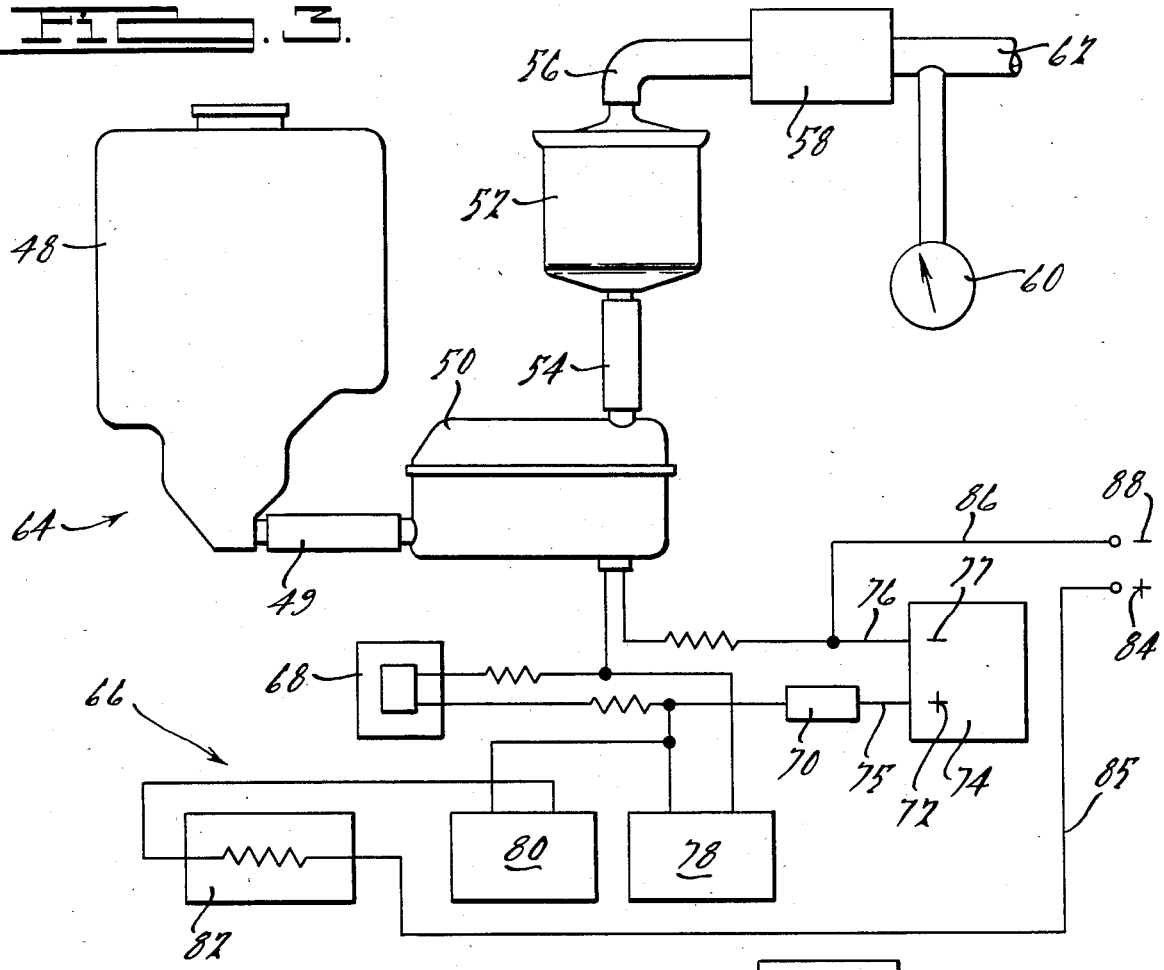
FIG. 3 is an elevated front view of an apparatus of the present invention as mounted on a movable cart.

Referring to FIG. 1, a vehicle 10 is shown having a fuel injection system 12 included and operably associated with an engine 14. A cart 16 is disposed adjacent the vehicle 10 upon which the control and pumping apparatus 15 of the present invention is disposed, as will be described hereafter. The fuel injection system 12, as illustrated schematically in FIG. 2, comprises a gas tank 18 from which a fuel feed pipe 20 communicates the gas tank with a fuel pump 22. The fuel pump 22 is controlled by a fuel pump relay mechanism 24 usually found within the passenger compartment 26 of the vehicle 10. The fuel pump 22 communicates with a pressure regulator 28 via fuel line 30. Fuel feed pipe 32 feeds fuel into the engine compartment 34 of the vehicle 10. Fuel feel feed pipe 32 communicates the fuel with a fuel filter 36 which in turn communicates on its opposite side via fuel pipe 38 with a distribution fuel pipe 40. The distribution pipe 40 communicates fuel to a series of fuel injectors 42 mounted on the engine 14. Each fuel injector communicates with one cylinder of the engine 14. Excess fuel is returned to the gas tank 18 via fuel return pipe 44 connected to the distribution fuel pipe 40 by a pressure regulator 46.

The apparatus 15 used for cleaning the fuel injection system 12, as illustrated schematically in FIG. 3, is mounted on a movable cart 16 (FIG. 1). A solvent tank 48 mounted on the cart and communicates via fuel line 49 with an electric fuel pump 50 also mounted on the cart. The electric fuel pump communicates with a fuel filter 52 via fuel line 54. The downstream side of the fuel filter 52 has a fuel line 56 which communicates with a pressure regulator 58 and pressure gauge 60. The downstream side of the pressure regulator and pressure gauge communciates with a fuel line 62 which can be operably associated with the fuel injection system 12 of the vehicle 10 as will be described later.

The cleaning apparatus 15 is comprised of two parts, a fuel injection cleaning supply system 64 and a control mechanism 66 for the supply system 64, both mounted on the cart 16. The electric fuel pump 54 is controlled by a pump switch 68 which is mounted in series with a fuse 70 to the positive terminal 72 of the car battery 74 via line 75. Switch 68 and fuse 70 are mounted in series with a ground line 76 (from the negative battery terminal 77) and the fuel pump. Also in parallel with the pump switch 68 are two timers, a 10-minute pump timer 78 and a precision 1-minute injection timer 80. The injection timer may also be a 10-minute timer for convenience as a 10-minute test. Precision of the injection timer 80 is needed so that the technician can be positive that the injector is clean (measuring the exact amount of flow through the injector). The injection timer 80 is mounted in series through a dropping resistor 82 with the positive fuel injector control system terminal 84 via line 85. A return ground line 86 from the negative fuel injector control system terminal 88 is connected with the return ground line 76 from the battery 74 to the fuel pump 54. A conventional burette (not shown) is also included in the cart to be used for ancillary volumetric fuel injector testing as will be described later.

The service procedure for cleaning the fuel injectors with the apparatus of the present invention involves an initial step of preparing the fuel injector cleaner mixture. One can of fuel injector cleaner (16 ounces or 1 pint size), which comprises aromatic petroleum distillate and butyl cellosolve, is poured into the solvent tank 48. Two pints of gasoline are poured into the solvent tank 48 using the empty can of solvent for measuring and the solution is stirred. The operator then disconnects the fuel return line 44 (FIG. 2) from association with the gas tank 18 and plugs the return line 44 with an appropriate stop. The fuel pump relay mechanism 24 is then disabled and the fuel filter hose 38 is disconnected just above the fuel filter 36 (FIG. 2). The fuel feed hose 62 from the cart 16 is then connected to the fuel pipe 38 to operably associate the cart fuel supply system 64 with the fuel injection system 12 of the vehicle 10. The control mechanism 66 is then connected to the vehicle electrical system by connecting lines 85 and 86 to the fuel injector control system terminals and lines 75 and 76 to the battery 74.

At this stage the cleaning operation is set to be commenced. The fuel pump switch 68 is turned to the ON position. The vehicle engine is started and the operator should check for leaks in either the apparatus system or the vehicle fuel system at this time. The engine idle speed is set at 1800 rpm. The engine is run at idle until the cleaner tank 48 is empty. Then the pump switch 68 is turned to the OFF position. The engine 14 continues idling until the speed drops or fluctuates, indicating that the fuel filter and supply line are emptied of cleaner mixture. At this point the engine is shut off and the cleaning apparatus is disconnected. The fuel return line plug is removed and allowed to drain. Return pipe 44 is then reinstalled and the fuel hose 38 is reinstalled on the fuel filter 36. The fuel pump relay 24 is also connected. The engine is started and the vehicle fuel system is checked again for leaks.

The apparatus 15 of the present invention also has an additional capability which may be provided as an added step to be used with the above-described method just subsequent to the cleaning procedure for the fuel injectors or as an entirely separate use of the apparatus 15. The added capability comprises running a volumetric test of the fuel injection system 12 by disconnecting the fuel injectors one by one after operably associating the cart system 64 with the fuel injection system 12 of the vehicle 10, measuring out a fixed amount of raw gas into the cleaner tank, running the engine such that the gas sprays out of the one nozzle into a burette, measuring the amount of liquid in the burette, and repeating the test for each nozzle. Multiplying the amount in the burette by 6 should give the original amount of raw gas and permit a fairly good estimate as to the amount of fuel going through each tested nozzle proportionate to the amount of fuel supplied to the nozzles.

Figure 4:
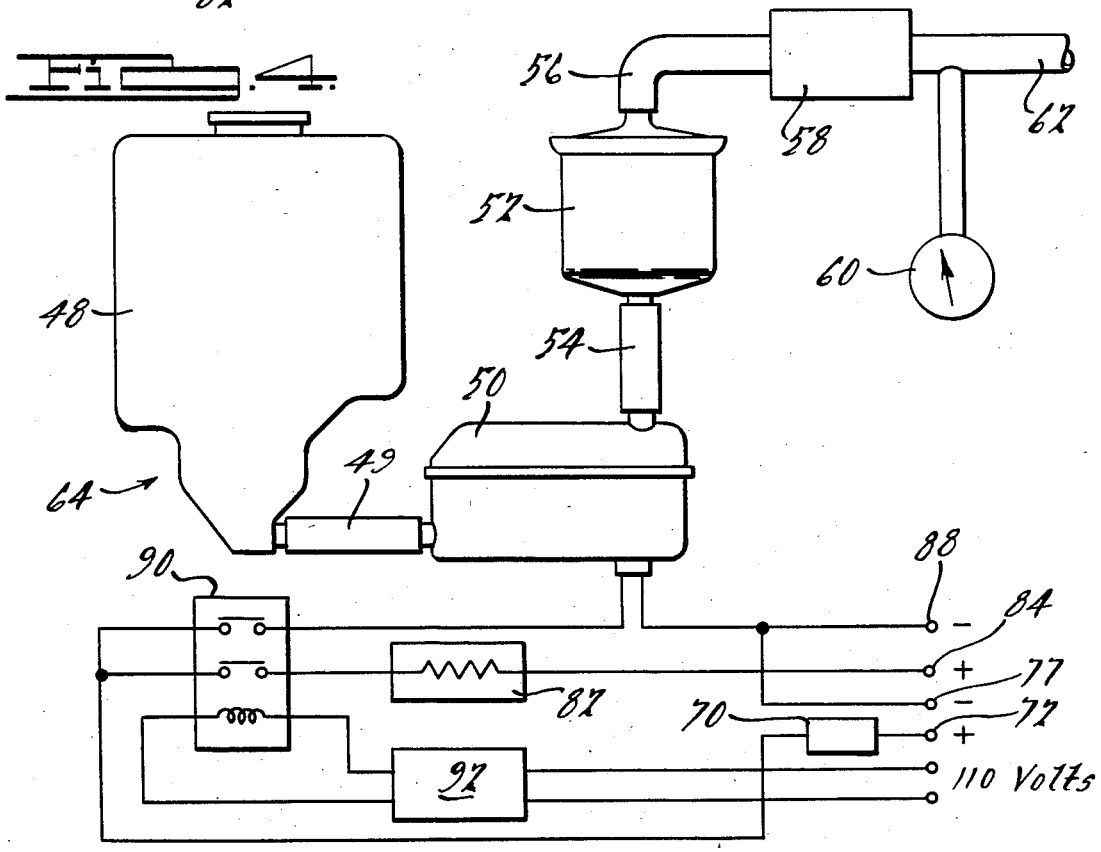
FIG. 4 is a view similar to FIG. 3 of an alternative embodiment of the present invention.

Referring to FIG. 4, an alternative embodiment of the fuel supply system 64 and control mechanism 66 on the cart 16 is illustrated. All of the components of the fuel supply system 64 are identical. The control mechanism 66, however, is altered using a 20 amp relay 90 in series with the fuse 70 instead of the pump switch 68. A 110 volt DC timer 92 is set across one set of terminals of the relay 90 to activate the relay 90 to start and stop the fuel supply system 64. A dropping resistor 82 is connected in series with the relay 90. All other aspects of the control mechanism 66 are the same as the prior described embodiment. When the timer 92 is set, the fuel pump will feed the solvent gas mixture into the fuel injection system and the fuel injector system will be operational for the amount of time that fuel is supplied. Thus the apparatus 15 can be left in operation and will shut itself off when the cleaning procedure has been performed.

The above two embodiments may also be accomplished with a manual pump switch mechanism in place of the timers so that an operator may monitor the operation and time the operation himself in whatever manner is desired. A combination of both manual and automatic operations may also be readily accomplished within the control system 66.

While it will be apparent that the preferred embodiments of the invention disclosed are well calculated to fulfill the objects above stated, it will be appreciated that the invention is susceptible to modification, variation and change without departing from the spirit of the invention herein described, or the scope of the subjoined claims.

We claim:

1. An apparatus for cleaning the fuel injection valve system of an engine, said valve system including at least one fuel injection valve operably secured to and associated with said engine and responsive to a charge of electricity to input fuel to said engine, means for supplying fuel to said at least one valve, means for controlling said at least one valve to feed fuel to said engine, and means for powering said controlling means, said apparatus comprising:

means for feeding a solvent-fuel mixture into said fuel supplying means of said engine, comprising:

an outlet conduit, a storage tank for a supply of said solvent-fuel mixture separate from said fuel supply means, means separate from said fuel supplying means for pumping said solvent-fuel mixture from said storage tank to said outlet conduit, and means for communicating said storage tank with said pumping means;

a control for said solvent-fuel mixture feeding means comprising means for charging said fuel injection valves with electricity to operate said valves, said charging means disposed in operable association with said engine, switch means for determining the commencement or cessation of operation of said feeding means, and means for operably associating said valve operating means and said switch means with said powering means, a device for transporting said control, said communicating means, said pumping means, said storage tank, and said outlet conduit to and from operable association with said engine; and means for operably associating said outlet conduit of said feeding means with said valve fuel supplying means and disabling said valve fuel supplying means to permit said feeding means to be the source of the fuel supply for said at least one fuel injection valve, wherein said apparatus is removed prior to use of said fuel supplying means to operate said engine.

2. An apparatus in accordance with claim 1, further comprising timer means overriding said manual switch means for ceasing operation of said apparatus after a selected amount of time.

3. An apparatus in accordance with claim 2, wherein said timer means includes means for controlling the operation of said pumping means.

4. An apparatus in accordance with claim 3, wherein said timer means further includes means for controlling the operation of said fuel injection valve operating means.

5. An apparatus in accordance with claim 2, wherein said timer means includes means for controlling the operation of said fuel injection valve operating means.

6. An apparatus in accordance with claim 2, wherein said controlling means for said feeding means further comprises relay means for controlling the operation of said pumping means and timer means for controlling said relay means overriding said manual switch means.

7. An apparatus in accordance with claim 1, wherein said feeding means further comprises means for filtering said mixture.

8. An apparatus in accordance with claim 1, wherein said feeding means further comprises means for regulating the pressure of said mixture downstream of said pumping means.

9. An apparatus in accordance with claim 8, wherein said feeding means further comprises a pressure gauge.

10. An apparatus in accordance with claim 1, wherein said valve system comprises a plurality of fuel injection valves disposed on one engine.

11. An apparatus in accordance with claim 1, further comprising means for collecting and measuring fluid downstream of said at least one fuel injection valve.

12. An apparatus for cleaning the fuel injection valve system of an engine, said valve system including at least one electronically pulsed fuel injection valve operably associated with said engine, means for supplying fuel to said at least one valve, means for controlling said at least one valve to pulse said at least one valve to feed fuel to said engine, and means for powering said controlling means, said apparatus comprising:

a source of power;

means for feeding a solvent-fuel mixture into said fuel supplying means of said vehicle engine, comprising an outlet conduit, a tank separate from said fuel supplying means for storing a supply of said solvent-fuel mixture, means separate from said fuel supplying means for pumping said solvent-fuel mixture from said storing tank to said outlet conduit, a first conduit communicating said storing tank with said pumping means, a filter element, a second conduit communicating said pumping means with said filter element, a pressure regulator, means for monitoring the pressure in said feeding means, and a third conduit communicating said filter element with said regulator;

means for controlling said solvent-fuel mixture feeding means, comprising means separate, at least in part, from said valve controlling means for operating said at least one fuel injection valve to electronically pulse said at least one valve to feed said solvent-fuel mixture to said engine, said operating means disposed in operable association with said vehicle engine, switch means for determining the commencement or cessation of operation of said feeding means, and means for operably associating said valve operating means and said switch means with said source of power; and means for operably associating said outlet conduit of said feeding means with said valve fuel supplying means to supply fuel to said at least one fuel injection valve from said storing tank of said feeding means.

13. A service apparatus for cleaning the electronically pulsed fuel injection valve system of an engine, said valve system including at least one electronically pulsed fuel injection valve operably secured to and associated with said engine, means for supplying fuel to said at least one valve, means for controlling said at least one valve to feed fuel to said engine, and means for powering said controlling means, said apparatus comprising: a solvent-fuel mixture; a storage element for said solvent-fuel mixture; means for pumping said solvent-fuel mixture from said storage element; a mechanism for communicating said pumping means to said at least one valve; a control system for the operation of said at least one valve and said puming means; a carrying device for said storage element, said pumping means, said control system, and at least a portion of said communicating mechanism; and means for operably associating said communicating mechanism with said at least one valve and disabling said valve fuel supplying means to permit said storage element to be the source of fuel supply for said at least one fuel injection valve, wherein said apparatus is placed in association with said engine by said carrying device, and said apparatus is removed from association with said engine by said carrying device during normal operation of said engine.

14. An apparatus in accordance with claim 13, wherein said solvent-fuel mixture is an aromatic petroleum distillate, butyl cellosolve, and fuel.

15. An apparatus in accordance with claim 13, wherein said engine is driven at a constant speed by said control system.

16. An apparatus in accordance with claim 13, said control system further comprising a timer to stop the operation of said apparatus after a desired amount of time.

* * * * *